US005357483A

United States Patent [19]

Innes

[11] Patent Number: 5,357,483

[45] Date of Patent: Oct. 18, 1994

[54] DOWNHOLE TOOL

[75] Inventor: Frank A. S. Innes, Aberdeen, Scotland

[73] Assignee: Halliburton Logging Services, Inc., Houston, Tex.

[21] Appl. No.: 133,763

[22] Filed: Oct. 7, 1993

Related U.S. Application Data

[63] Continuation of Ser. No. 12,489, Feb. 2, 1993, abandoned.

[30] Foreign Application Priority Data

Oct. 14, 1992 [GB] United Kingdom ..... 9221563.1

[51] Int. Cl.[5] ..... G01V 1/40

[52] U.S. Cl. ..... 367/84

[58] Field of Search ..... 367/83, 84, 85

[56] References Cited

U.S. PATENT DOCUMENTS

| | | | |
|---|---|---|---|
| 4,785,300 | 11/1988 | Chia et al. | 367/84 |
| 4,847,815 | 7/1989 | Malone | 367/84 |
| 4,914,637 | 4/1990 | Goodsman | 367/83 |
| 5,073,877 | 12/1991 | Jeter | 367/84 |

FOREIGN PATENT DOCUMENTS 214541A 6/1989 United Kingdom .

252992A 8/1992 United Kingdom .

*Primary Examiner*—Ian J. Lobo

*Attorney, Agent, or Firm*—Arnold, White & Durkee

[57] ABSTRACT

A downhole tool (100) for generating pressure pulses in a drilling fluid comprising an elongate body (107, 127) and a plurality of blades (116) spaced around the body. The blades are each divided into an independent front section (**116*a*) and rear section (116*b*), forming a set of front sections and a set of rear sections, at least one of the set of front sections and the set of rear sections being mounted for rotation and being angularly displaceable relative to each other between a first position in which the sections are aligned and a second position in which the rear sections obstruct fluid flow between the front sections to generate a pressure pulse. The tool includes a first set of driving blades in front of the blades (116) for generating a torque on the blade sections, the driving blades being curved in a first direction, and an escapement means (129) which is radially movable to permit stepwise rotation of the blade sections, and thus to move the blade sections between the first and second positions. The tool additionally comprises a set of stator blades (162**) positioned in front of the set of front sections. The stator blades are curved in a second direction opposite to the first direction.

7 Claims, 3 Drawing Sheets

DOWNHOLE TOOL

This application is a continuation of application Ser. No. 08/012,489, filed Feb. 2, 1993.

BACKGROUND OF THE INVENTION

The invention relates to a downhole tool such as a well-logging tool, and more particularly to a tool of the measure-while-drilling (MWD) type.

When oil wells or other boreholes are being drilled it is frequently necessary to determine the orientation of the drilling tool so that it can be steered in the correct direction. Additionally, information may be required concerning the nature of the strata being drilled, or the temperature or pressure at the base of the borehole, for example. There is thus a need for measurements of drilling parameters, taken at the base of the borehole, to be transmitted to the surface.

One method of obtaining at the surface the data taken at the bottom of the borehole is to withdraw the drill string from the hole, and to lower measuring instrumentation including an electronic memory system down the hole. The relevant information is encoded in the memory to be read when the instrumentation is raised to the surface. Among the disadvantages of this method are the considerable time, effort and expense involved in withdrawing and replacing the drill string. Furthermore, updated information on the drilling parameters is not available while drilling is in progress.

A much-favoured alternative is to use a measure-while-drilling tool, wherein sensors or transducers positioned at the lower end of the drill string continuously or intermittently monitor predetermined drilling parameters and the tool transmits the appropriate information to a surface detector while drilling is in progress. Typically, such MWD tools are positioned in a cylindrical drill collar close to the drill bit, and use a system of telemetry in which the information is transmitted to the surface detector in the form of pressure pulses through the drilling mud or fluid which is circulated under pressure through the drill string during drilling operations. Digital information is transmitted by suitably timing the pressure pulses. The information is received and decoded by a pressure transducer and computer at the surface.

The drilling mud or fluid is used to cool the drill bit, to carry chippings from the base of the bore to the surface and to balance the pressure in the rock formations. Drilling fluid is pumped at high pressure down the centre of the drill pipe and through nozzles in the drill bit. It returns to the surface via the annulus between the exterior of the drill pipe and the wall of the borehole.

In a number of known MWD tools, a negative pressure pulse is created in the fluid by temporarily opening a valve in the drill collar to partially bypass the flow through the bit, the open valve allowing direct communication between the high pressure fluid inside the drill string and the fluid at lower pressure returning to the surface via the exterior of the string. However, the high pressure fluid can cause serious wear on the valve, and often pulse rates of only up to about 1 pulse per second have been achieved by this method. Alternatively, a positive pressure pulse can be created by temporarily restricting the flow through the downpath within the drill string by partially blocking the downpath.

U.S. Pat. No. 4,914,637 (Positec Drilling Controls Ltd) discloses a number of embodiments of MWD tool having a pressure modulator for generating positive pressure pulses. The tool has a number of blades equally spaced about a central body, the blades being split in a plane normal to the longitudinal axis of the body to provide a set of stationary half-blades, and a set of rotary half-blades. A temporary restriction in the fluid flow is caused by allowing the rotary half-blades to rotate through a limited angle, so that they are out of alignment with the stationary half-blades, the rotation being controlled by a solenoid-actuated latching means. In one embodiment, the drilling fluid is directed through angled vanes in front of the split blades in order to impart continuous torque to the rotary half-blades, such that the rotary half-blades rotate through a predetermined angle in the same direction each time the latch is released, thus being rotated successively into and out of alignment with the stationary half-blades.

The provision of angled driving vanes or blades upstream of the pulse-generating rotary half-blades is a generally convenient way of providing the necessary torque to the rotary half-blades to enable them to rotate and thus generate the pulses. We have found, however, that this arrangement can give rise to certain problems. In particular, as the flow of drilling fluid acts on the driving blades to provide the required driving force, an equal and opposite force is exerted on the fluid which, as a result, develops a swirling motion. The swirling motion of the fluid then tends to impair the operation of the downstream pulse-generating half-blades. In particular, the swirl of the fluid acts on the half-blades in the direction opposite to that in which the half-blades are being driven to generate the pressure pulses. Clearly, this may impede or even prevent the movement of the half blades, and thus the generation of the pulses.

SUMMARY OF THE INVENTION

In accordance with the present invention, the problem described above is reduced or overcome by providing, upstream of the pulse-generating half-blades, means for substantially cancelling out or removing the swirling motion of the fluid so that the fluid has a generally straight even flow as it encounters the pulse-generating half-blades.

According to the present invention there is provided a downhole tool for generating pressure pulses in a drilling fluid, the tool comprising an elongate body for positioning in a drill collar of a drill string; a plurality of blades spaced around the body, each blade being divided into an independent front section and rear section, forming a set of front sections and a set of rear sections, at least one of the set of front sections and the set of rear sections being mounted for rotation and being angularly displaceable relative to one another between a first position in which the sections are aligned and a second position in which the rear blade sections obstruct the fluid flow between the front sections to generate a pressure pulse; a first set of driving blades in front of the plurality of blades for generating a torque on the front sections, the driving blades being curved in a first direction; and escapement means to permit stepwise rotation of the blade sections between said first and second positions; characterised in that the tool additionally comprises means positioned in front of the set of front sections whereby the fluid has very little, if any, swirling motion as it reaches the said set of front sections.

In a preferred embodiment, said means comprises at least one stator blade, usually a set of stator blades, positioned in front of the set of front sections the stator blades being curved in a second direction opposite to said first direction. Thus, swirl in a first direction is imparted to the fluid by the stator blades and swirl in the opposite direction is imparted to the fluid by the first set of driving blades, such that the swirling motions substantially cancel each other out and the fluid passes through the pulse-generating half-blades with very little, if any, swirl.

In a preferred embodiment the first set of driving blades are positioned in front of the set of front sections, and the stator blades are positioned in front of the first set of driving blades.

In U.S. Pat. No. 4,914,637, the rotary half-blades always move in the same direction with respect to the stationary half-blades. As a result, a scissor action occurs between the leading edge of the rotary half-blades and the trailing edge of the stationary half-blades at the interface between the half blades, as the rotary half-blades move from the position where they are out of alignment with the stationary half-blades to the aligned position of the next stationary half blade. Thus, any debris or other foreign matter which finds its way into the drilling mud, may be caught at the interface of the blades as this scissor action occurs and thus jam the whole tool, or cause considerable damage to the blades.

Our copending British patent application no. 9120854.6 aims to overcome this disadvantage, by providing a means of moving either one or both of the front and rear sets of half blades such that each successive incremental rotation of one set of half-blades relative to the other set of half-blades occurs in the opposite direction to the previous incremental rotation relative to the other set of half-blades.

In the illustrated embodiment of copending British patent application no. 9120854.6, both sets of half-blades are mounted for rotation such that said rear half-blades are rotatable in one direction from the first to the second position, and said front half-blades are subsequently rotatable in said one direction from said second to said first position. The half-blades are mounted on a rotatable member and the torque is developed by means of the front and rear half-blades, which are curved to act as lifting sections.

The arrangement of the present invention is equally applicable to the scissor-type arrangement of U.S. Pat. No. 4,914,637 and to the non-scissor arrangement of our British patent application no. 9120854.6. In the latter case, the first set of driving blades generates a torque on the front sections and a second set of driving blades is also provided for generating a torque on the rear sections, the driving blades preferably being curved in the first direction, and preferably being placed at the rear of the set of rear sections.

DETAILED DESCRIPTION OF THE DRAWINGS

Figure 1:
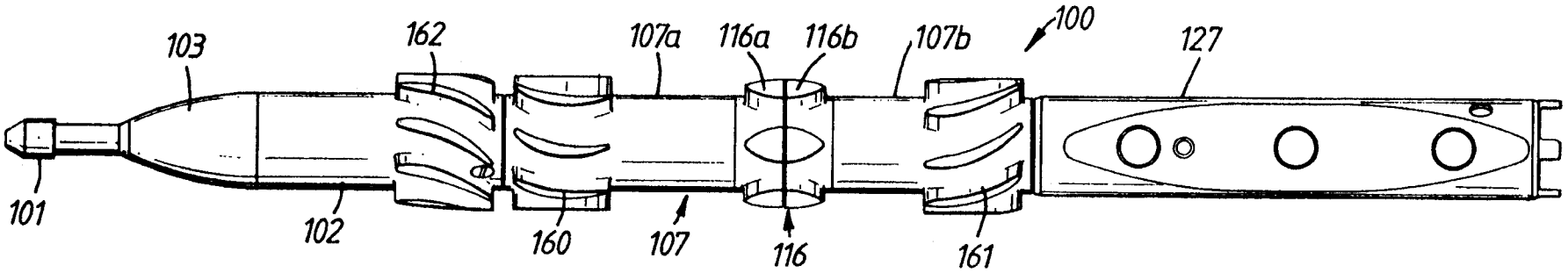
FIG. 1 is a plan view of an embodiment of a downhole tool for generating pressure pulses in a drilling fluid.
Figure 2A:
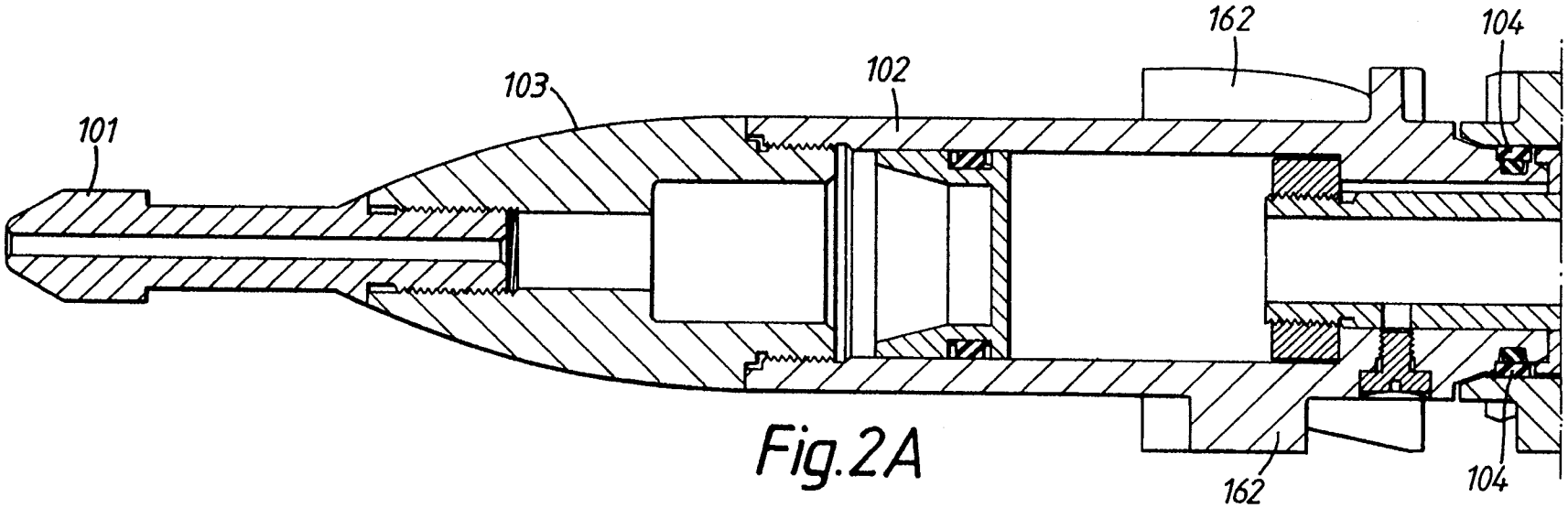
FIGS. 2A, 2B and 2C together show a longitudinal cross-sectional view of the tool of FIG. 1.
Figure 2B:
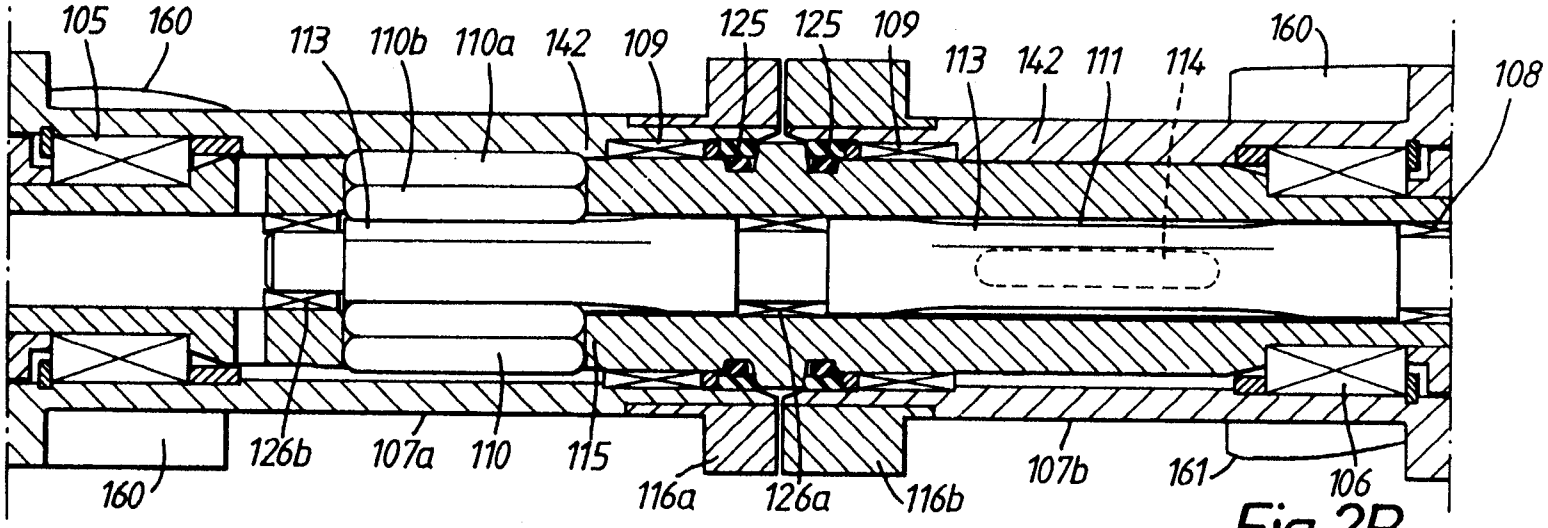
Figure 2C:
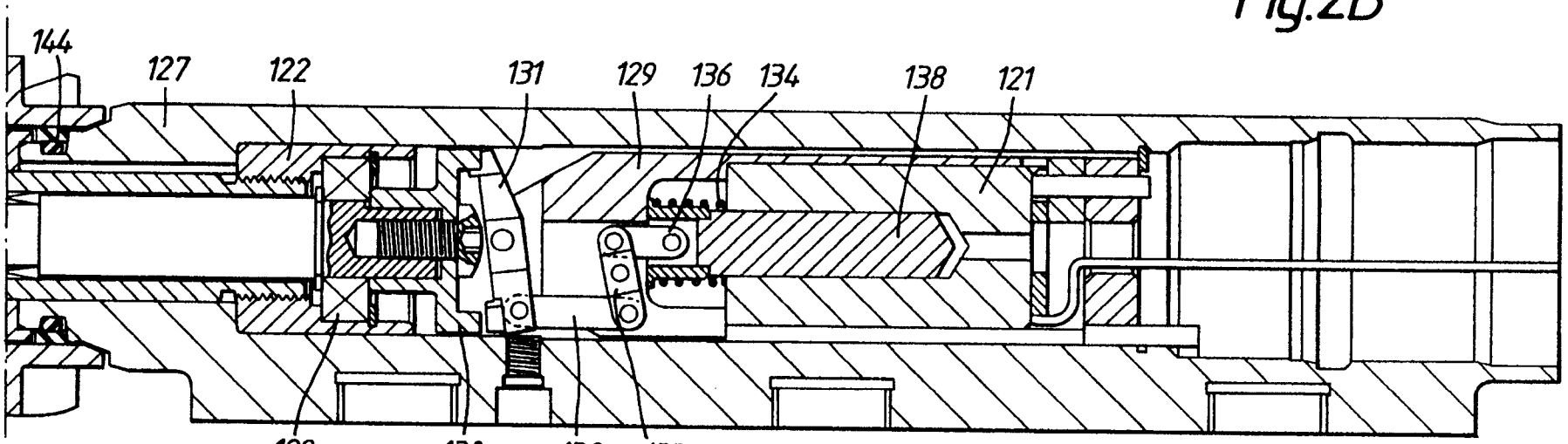

A preferred embodiment of the invention is shown in the FIGURES. A downhole tool, generally indicated by reference numeral 100 has a streamlined casing 103 facing into the downward flow of drilling fluid. A standard fishing end 101 extends from the casing, and permits the tool to be manipulated or to be retrieved should the tool need to be brought to the surface. A pressure balance housing or stator 102 extends downstream of the casing 103 and a rotatable sleeve 107 extends downstream of the stator. A stationary inner sleeve 124 extends coaxially with the rotatable sleeve 107, as shown in FIG. 2B. Towards its upstream end, the rotatable sleeve is sealed against the stator 102 by a seal 104, and is supported on the inner sleeve by bearings 106. Towards its downstream end, the rotatable sleeve is sealed against an escapement housing 127 by a seal 144, and is supported on the inner sleeve by a bearing 105, while the escapement housing 127 is held fast with the inner sleeve by means of a retaining nut 122. The seals 104 and 144 prevent ingress of drilling fluid to the bearings 106 and 105 respectively.

The rotatable sleeve 107 has formed thereon a number of blades 116, each blade comprising a front blade section **116*a* and a rear blade section 116*b*. The rotatable sleeve is split in a plane normal to the longitudinal axis of the tool such that the rear portion 107*b* of the rotatable sleeve and the front portion 107*a* of the rotatable sleeve can rotate relative to each other, and thus the rear blade section 116*b* and the front blade section 116*a* can rotate relative to each other. When the front and rear blade sections are aligned they form a set of streamlined blades, between which the drilling fluid can flow with a low drag coefficient.. The shape of each aligned blade can be seen most clearly in the solid lines shown in FIG. 3. When the relative rotation of the front and rear blade sections is such that the rear blade sections lie in a position of misalignment with respect to the front blade sections, as shown in the broken outlines in FIG. 3**, the drag coefficient is greatly increased, and a pressure pulse is transmitted through the drilling fluid.

A set of driving blades 160 is provided on the front portion **107*a* of the rotatable sleeve upstream of the pulse-generating blades 116, and a further set of driving blades 161 is provided on the rear portion 107*b* of the rotatable sleeve downstream of the pulse-generating blades 116. The two sets of driving blades 160, 161 are curved relative to the direction of flow of the drilling fluid, such that the resulting lift component acting on the blades tends to rotate the front and rear portions of sleeve 107 about the inner sleeve 124. Thus a continuous torque is supplied to the blade sections 116*a* and 116*b***, and the main driving force for creating the pressure pulses is derived directly from the energy in the drilling fluid, so that the additional energy requirement from downhole batteries or a turbine is very low.

Each front blade section has a generally planar rear end 112 extending generally normal to the direction of fluid flow and each rear blade section has a generally planar forward end 115 extending generally normal to the direction of fluid flow. These rear and forward ends 112 and 115 form adjacent faces of the blade sections when the blade sections are aligned, and preferably comprise a layer of wear resistant material which reduces abrasion of the faces of the blade sections.

Additional bearings 109 support the front and rear portions of the rotatable sleeve 107 on the inner sleeve 124, and seals 125 are provided between the inner sleeve and the rotatable sleeve close to the split in the rotatable sleeve.

A camshaft 111 is received within the inner sleeve 124 such that it can rotate coaxially within the inner sleeve on needle roller bearings 108 at the forward end of the camshaft and on deep groove ball bearings 128 at the downstream end of the camshaft. The ball bearings 128 are mounted between the camshaft and the retaining nut 122 which supports the escapement housing 127 on the inner sleeve 124. Two additional sets of needle roller bearings 126*a* and 126*b* are provided along the length of the camshaft 111.

An escapement mechanism 129 is provided on the downstream end of the camshaft. The escapement mechanism comprises an escapement wheel 130, and a catch 131. The escapement mechanism is operated by a solenoid 121 having a plunger 138. The catch 131 is connected to a catch link 132 which in turn is connected to a rocking arm 133. The plunger 138 is connected to the rocking arm 133 by means of a link 136. The catch 131 is operable to move into and out of engagement with the escapement wheel 130 by means of the solenoid plunger 138. A return spring 134 also acts on the plunger such that the solenoid pulls the plunger in one direction, and the spring 134 provides the return force in the opposite direction. Alternatively, the escapement mechanism may comprise a ratchet and a pawl, the pawl being linked to the plunger of a tubular solenoid, as shown in our copending British Patent Application 9120854.6, or may be provided by any other suitable arrangement. The cam shaft 111 has a number of lugs 113 spaced equi-angularly around its circumference, and the inner sleeve 124 is provided with a number of longitudinal slots 114, 115 in each of which are positioned two escapement rollers 110. The rollers 110 in longitudinal slots 114 cooperate with the front portion 107*a* of the rotatable sleeve, and the rollers in longitudinal slots 115 cooperate with the rear portion of the rotatable sleeve. The rotatable sleeve has internally projecting teeth 142. As the camshaft rotates, a lug 113 engages an inner roller 110*a* and cams it outwards, thus also camming outer roller 110*b* outwards such that it protrudes beyond the outer edge of inner sleeve 124 and into the path of internal teeth 142 on rotatable sleeve 107. Thus, as front portion 107*a* or rear portion 107*b* rotates under the constant torque provided by the driving blades 160, 161 an internal tooth 142 engages outer roller 110*b* and further rotation is prevented until the camshaft is moved on.

The camshaft escapement mechanism is operated to release the camshaft and, when the cam shaft is freed, it rotates under the continuous torque supplied by the driving blades until the camshaft is locked in a stationary position once more.

Controlling the movement of the camshaft controls the movement of the rotatable sleeve to incremental steps of rotation. The rear portion 107*b* moves in a first direction of rotation through a predetermined angle and then the front portion 107*a* moves through that angle in the same direction, such that rear blade portions 116*b* move from a position where they are aligned with the front blade portions to a position of maximum misalignment, and then the front blade portions 116*a* move from the misaligned position back into alignment with the rear blade portions, i.e. the rear blade portions move out of alignment when the camshaft is released and then the front blade portions move to catch them up the next time the camshaft is released.

As previously discussed, with the arrangement of blades described so far, the flow of drilling fluid emerging from the first set of driving blades 160 has developed a swirling motion as a result of its action on the driving blades 160. This swirling motion causes the fluid to act on the blades 116 in the direction opposite to that in which the front and rear blade sections 116*a*, 116*b* are being driven to generate the pressure pulses, and the pulse generation may therefore be affected. In order to overcome this difficulty, an additional set of curved blades 162 is provided on the stator 102 upstream of the driving blades 160.

Figure 3:
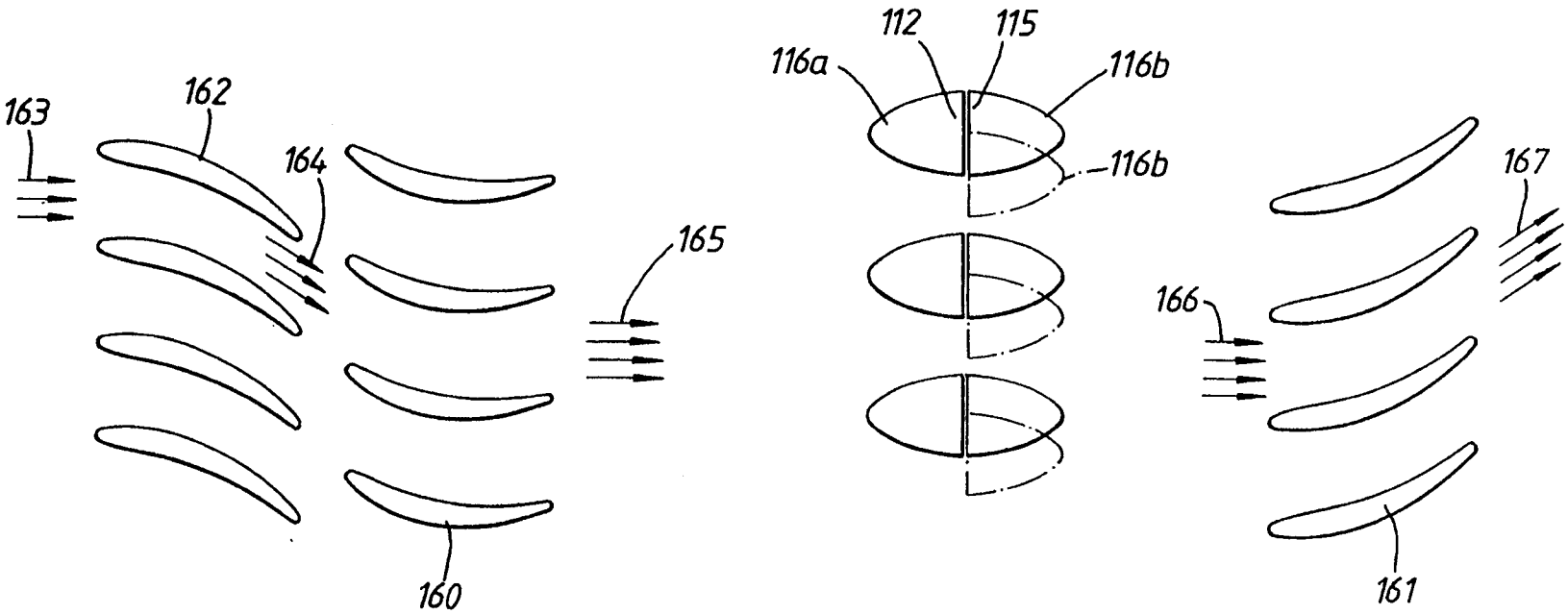
FIG. 3 shows detail of the blade arrangements on the tool of FIG. 1.

The stator blades 162 are curved in the opposite direction to the curvature of the driving blades 160, 161, as can be most clearly seen in FIG. 3. Thus incoming fluid indicated by arrows 163 is deflected by the stator blades 162 and flows into the driving blades 160 with a swirling motion indicated by arrows 164. Because the driving blades 160 are curved in the opposite direction to the stator blades 162 swirl in the opposite direction is imparted to the fluid by the driving blades 160, and thus the swirling motion is substantially cancelled out and the fluid emerges from the driving blades in an axial direction as indicated by arrows 165. The fluid thus passes through the half blades 116 in an axial direction without impeding the operation of the half blades, and the fluid flows into the further set of driving blades 161 as indicated by arrows 166, acts on the driving blades 161 to generate the necessary torque and emerges from the driving blades with a swirling motion indicated by arrows 167.

The particular shape and position of the stator blades 162 and the driving blades 160, 161 should be selected to minimise the swirling motion of the fluid through the blades 116.

Although the present invention has been discussed particularly as an improvement to the tool disclosed in our copending British Patent Application No. 9120854.6, clearly curved stator blades of the present invention, or other means of removing swirl from the fluid flow, could be used to improve the performance of any pressure pulser having curved driving blades or other swirl-producing means upstream of the pulse generating blades.

Preferably, means are provided for reducing torsional vibration of the rotatable sleeve by a damping fluid such as oil contained within the rotatable sleeve.

What I claim is:

1. A downhole tool for generating pressure pulses in a drilling fluid, the tool comprising an elongate body for positioning in a drill collar of a drill string; a plurality of blades spaced around said body, each blade being divided into an independent front section and rear section, forming a set of front sections and a set of rear sections at least one of said set of front sections and said set of rear sections being mounted for rotation and being angularly displaceable relative to one another between a first position in which the sections are aligned and a second position in which the rear blade sections obstruct the fluid flow between the front sections to generate a pressure pulse; a first set of driving blades in front of said plurality of blades for generating a torque on the blade sections, the driving blades being curved in a first direction; and escapement means to permit stepwise rotation of the blade sections between said first and second positions; wherein the tool additionally comprises means positioned in front of the set of front sections to reduce swirl of the drilling fluid immediately upstream of said set of front sections.

2. A tool according to claim 1, wherein said means positioned in front of the set of front sections to reduce swirl of the drilling fluid comprises a set of stator blades curved in a second direction opposite to said first direction of curvature of the driving blades.

3. A tool according to claim 2, wherein the first set of driving blades are positioned in front of the set of front sections, and the stator blades are positioned in front of the first set of driving blades.

4. A tool according to claim 1, wherein said first set of driving blades generate a torque on the front sections, and a second set of driving blades are provided for generating a torque on the rear sections.

5. A tool according to claim 4, wherein the second set of driving blades are curved in said first direction.

6. A tool according to claim 4, wherein each successive stepwise rotation of one of the sets of blade sections occurs in the same circumferential direction as the immediately preceding stepwise rotation of the other of the sets of blade sections.

7. A tool according to claim 2, wherein each successive stepwise rotation of one of the sets of blade sections occurs in the same circumferential direction as the immediately preceding stepwise rotation of the other of the sets of blades sections.

* * * * *